US007509787B2

(12) United States Patent
Ballestrazzi et al.

(10) Patent No.: US 7,509,787 B2
(45) Date of Patent: Mar. 31, 2009

(54) METHOD FOR THE PACKAGING OF EDITORIAL PRODUCTS AND LABELS IN PLASTIC FILM

(75) Inventors: Aris Ballestrazzi, Savignano sul Panaro (IT); Lamberto Tassi, Savignano sul Panaro (IT)

(73) Assignee: SITMA S.p.A., Modena (IT)

( * ) Notice: Subject to any disclaimer, the term of this patent is extended or adjusted under 35 U.S.C. 154(b) by 0 days.

(21) Appl. No.: 11/543,443

(22) Filed: Oct. 5, 2006

(65) Prior Publication Data

US 2007/0090011 A1 Apr. 26, 2007

(30) Foreign Application Priority Data

Oct. 21, 2005 (IT) ..... MI2005A2011

(51) Int. Cl.
*B65B 25/14* (2006.01)
*B65B 61/20* (2006.01)
*B65B 9/06* (2006.01)

(52) U.S. Cl. ..... 53/411; 53/415; 53/450; 53/131.2; 53/135.3; 53/550; 206/459.5

(58) Field of Classification Search ..... 53/411, 53/415, 450, 131.2, 131.4, 135.1–135.3, 53/550
See application file for complete search history.

(56) References Cited

U.S. PATENT DOCUMENTS 2,259,866 A * 10/1941 Stokes ..... 53/415
2,260,064 A * 10/1941 Stokes ..... 53/415
2,294,220 A * 8/1942 Albertson ..... 53/415
2,983,087 A * 5/1961 Schofield ..... 53/410
3,014,638 A * 12/1961 Farley ..... 53/415
3,254,828 A * 6/1966 Lerner ..... 383/37
3,274,746 A * 9/1966 James et al. ..... 53/433
3,540,183 A * 11/1970 Bodolay et al. ..... 53/415
3,958,390 A * 5/1976 Pringle et al. ..... 53/433

(Continued)

FOREIGN PATENT DOCUMENTS

EP 1 188 670 A 3/2002

(Continued)

OTHER PUBLICATIONS

European Search Report dated May 5, 2008.

*Primary Examiner*—Stephen F Gerrity
(74) *Attorney, Agent, or Firm*—James V. Costigan; Hedman & Costigan, P.C.

(57) ABSTRACT

A method for the packaging of editorial products (11) in plastic film comprising the phases of unwinding a plastic film (12) from a bobbin (13) and feeding it in a longitudinal direction (F), applying preprinted self-adhesive labels (16) to the film (12) transversally with respect to the longitudinal direction (F) and distanced between each other by a pre-established length greater than the length of the editorial products (11), positioning the editorial products (11) on the film (12) in the space between two subsequent labels (16), folding the plastic film (12) over the editorial products (11), welding the plastic film (12) longitudinally and transversally with a first transversal welding line (22) to form two containment areas (100*a*, 100*b*) of the label (16) and editorial product (11) respectively, and also with a second transversal welding line (23) forming a head of a finished packaging (100, 100') separated by the second transversal welding.

4 Claims, 3 Drawing Sheets

U.S. PATENT DOCUMENTS

Figure 1:
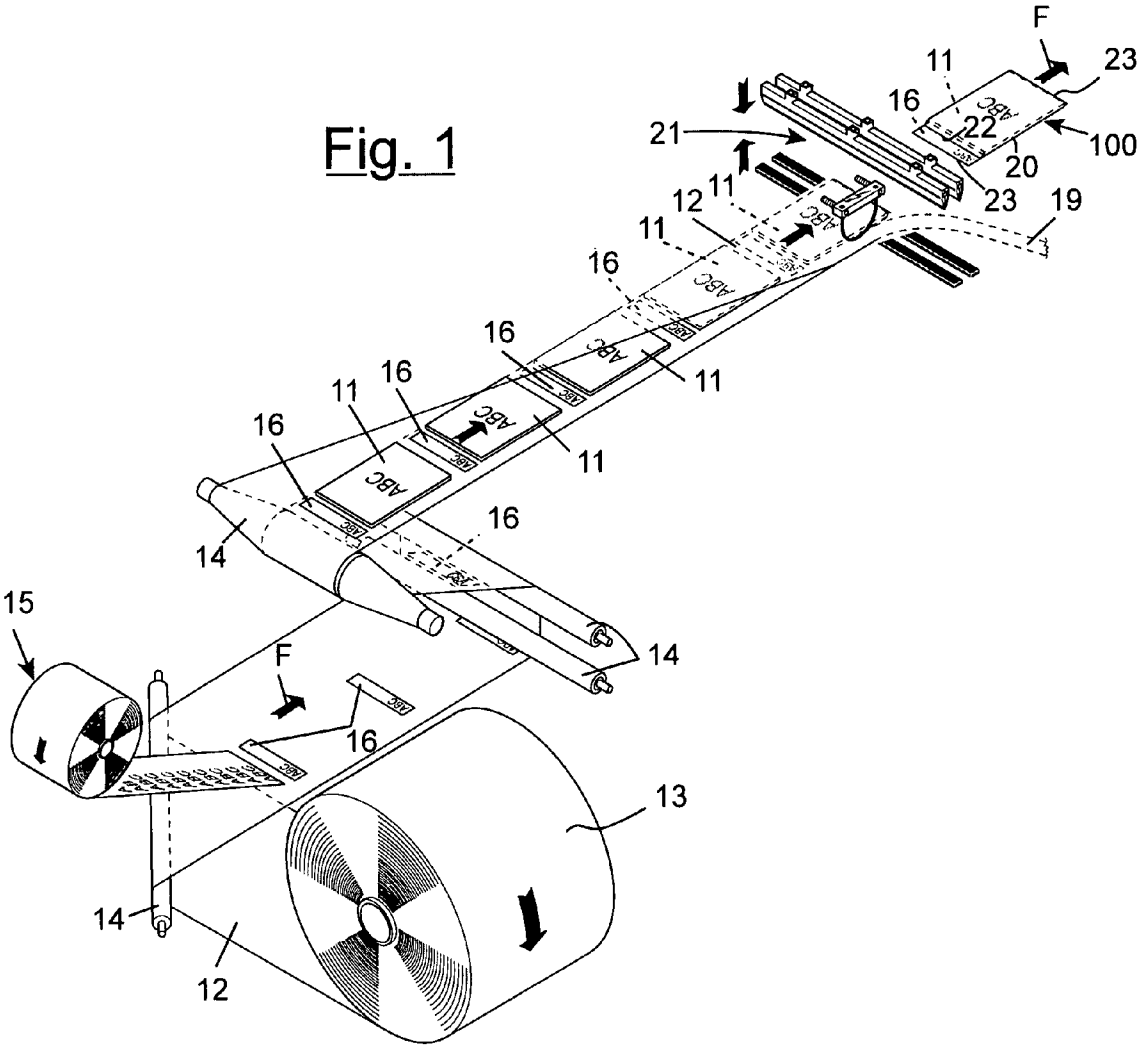

| | | | | | |
|---|---|---|---|---|---|
| 4,219,988 | A | * | 9/1980 | Shanklin et al. | 53/550 |
| 4,290,467 | A | * | 9/1981 | Schmidt | 206/459.5 |
| 4,337,058 | A | * | 6/1982 | Lerner | 493/11 |
| 4,338,768 | A | * | 7/1982 | Ballestrazzi et al. | 53/131.2 |
| 4,566,252 | A | * | 1/1986 | Watanabe et al. | 53/410 |
| 4,662,147 | A | * | 5/1987 | Scheja | 53/135.2 |
| 4,663,915 | A | * | 5/1987 | Van Erden et al. | 53/450 |
| 4,726,171 | A | * | 2/1988 | Kreager et al. | 53/410 |
| 4,790,119 | A | * | 12/1988 | McDaniels | 53/411 |
| 5,247,781 | A | * | 9/1993 | Runge | 53/412 |
| 5,417,041 | A | | 5/1995 | Hansen et al. | |
| 5,546,732 | A | * | 8/1996 | Coleman et al. | 53/450 |
| 5,875,614 | A | * | 3/1999 | Youngs et al. | 53/455 |
| 5,950,401 | A | | 9/1999 | Blohm et al. | |
| 6,185,908 | B1 | * | 2/2001 | Madderom | 53/415 |
| 2006/0010839 | A1 | * | 1/2006 | Koppen et al. | 53/450 |
| 2007/0261371 | A1 | * | 11/2007 | Ballestrazzi et al. | 53/450 |

FOREIGN PATENT DOCUMENTS

| | | | |
|---|---|---|---|
| EP | 1 621 461 | A | 2/2006 |
| FR | 2 611 965 | A | 9/1988 |

* cited by examiner

METHOD FOR THE PACKAGING OF EDITORIAL PRODUCTS AND LABELS IN PLASTIC FILM

The present invention relates to a method for the packaging of editorial products in plastic film and a relative packaging.

Editorial products such as newspapers, magazines or similar products are packaged in plastic film to protect them or join them to other products or gadgets, both for their direct distribution and also to be sent as subscriptions.

In particular, editorial products distributed for example in newspaper kiosks, are positioned on shelves and displayers stacked together or close to other products. It is therefore necessary to make the product and its contents more visible.

Packaging, for example, together with the editorial product, a cardboard sheet having larger dimensions which, in the protruding portion with respect to the product, contains a brief index of the items treated and also other elements capable of attracting the attention of the user, is known.

Packaging an editorial product with preprinted plastic film, in particular in particularly visible areas, for the same reasons specified above, is also known.

An objective of the present invention is to provide a method for the packaging of editorial products in plastic film which can be applied to traditional packaging machines with minimum adaptations.

Another objective of the present invention is to provide a method for the packaging of editorial products in plastic film to produce a relative packaging equipped with a protruding band with respect to the editorial product.

A further objective of the present invention is to provide a method for the packaging of editorial products in plastic film and a relative packaging which is particularly simple and functional, with reduced costs.

These objectives according to the present invention can be achieved by providing a method for the packaging of editorial products in plastic film.

Figure 2:
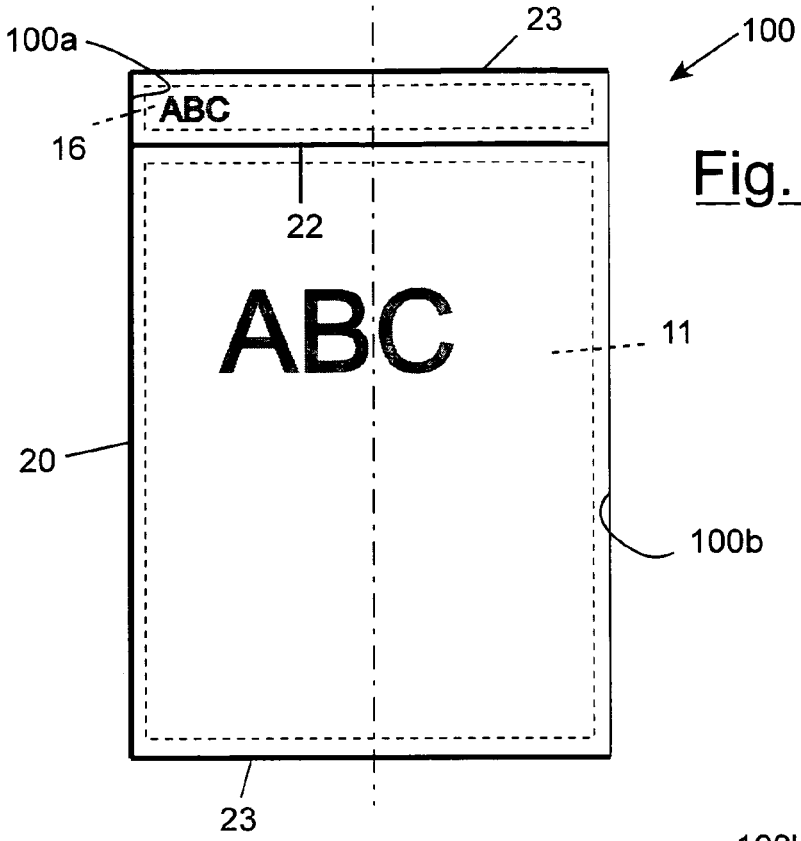
Figure 4:
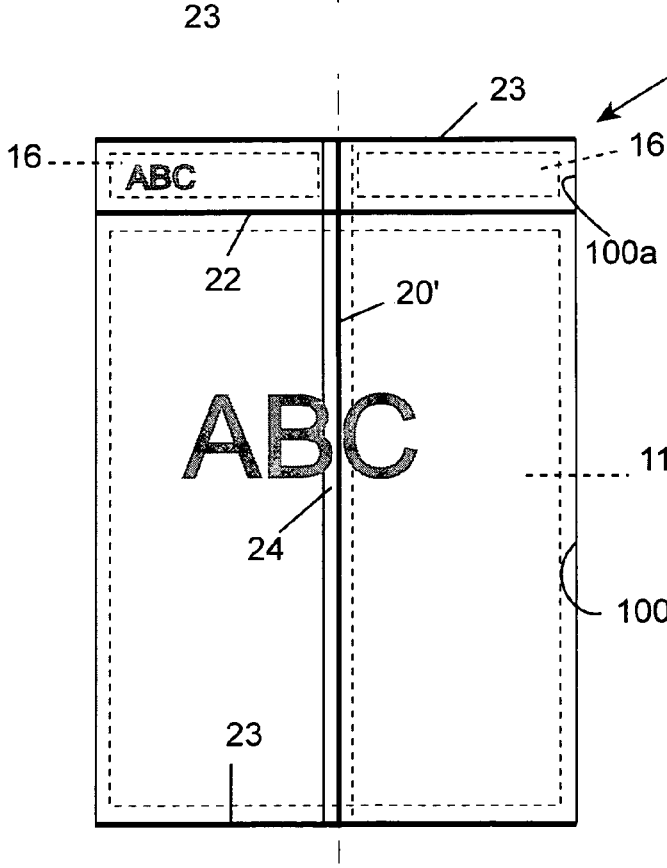
Figure 3:
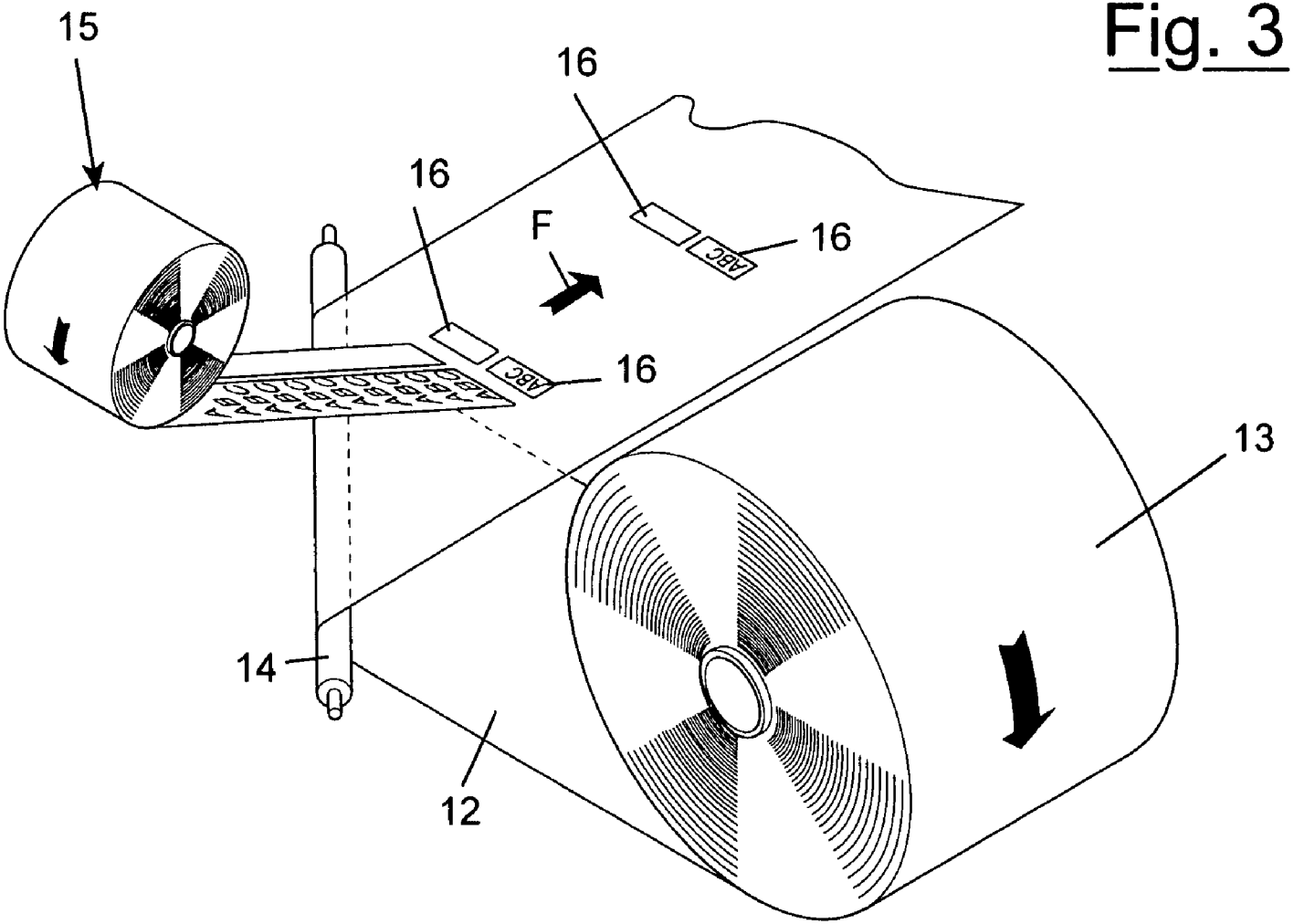

The characteristics and advantages of a method for the packaging of editorial products in plastic film and a relative packaging according to the present invention will appear more evident from the following, illustrative and non-limiting description, referring to the enclosed schematic drawings, in which:

FIG. 1 is a schematic view of a packaging machine for the embodiment of a method for the packaging of editorial products in plastic film, object of the present invention;

FIG. 2 schematically shows a packaging obtained on the machine of FIG. 1;

FIG. 3 schematically shows a different application of labels on a plastic film in a packaging machine such as that of FIG. 1;

FIG. 4 schematically shows a packaging obtained on the machine of FIG. 3.

With reference to the figures, these schematically show a packaging machine, indicated as a whole with 10, on which a method is applied for the packaging of editorial products 11 in a plastic film 12 for producing a relative packaging 100 (FIG. 2) or 100' (FIG. 4).

The plastic film 12, which is fed laterally from a bobbin 13, is sent onto a roll 14 in a longitudinal direction F.

Preprinted self-adhesive labels 16 are applied to the film 12 transversally with respect to the feeding direction F and distanced between each other by a pre-established length greater than the length of the editorial products 11 to be packaged.

The labels 16 can alternatively be all the same as each other and fed from a roll 15, as schematised in FIG. 1, or they can be applied by a labeller equipped with a printing head of the known type.

The labels 16, which can be indifferently produced in a single piece or in various adjacent parts, are for example all decorated with the same design, or have differentiated prints. By means of a labeller with a printing head 15, for example, it is possible to print on each label 16, or on a part thereof, a different shipping address, for example for magazines and other editorial products to be sent as subscriptions.

According to what is shown in FIG. 1, the pre-printed self-adhesive labels 16 are applied transversally to the film 12.

The plastic film 12 carrying the labels 16 is fed through a series of return rolls 14 to a packaging area, wherein the editorial products to be packaged 11 are positioned on the film 12 in the space between two successive labels 16.

The plastic film 12 is folded over the editorial products 11 along their edge, by means of known deviation devices, not shown, and welded longitudinally, by means of a welding and cutting 18 device, for example of the known hot blade type, schematically shown in FIG. 1.

In this way a portion of a scrap 19 of film 12 is cut contemporaneously with a longitudinal welding line 20 situated along one side of the packaging 100.

Two transversal weldings of the plastic film, for example, are also effected by means of double welding rods 21, also of the known type and only schematically illustrated in FIG. 1, which form the packaging 100 and separate it from the film 12 being fed.

A first transversal welding line 22, in fact, defines two containment areas, a containment area 100*a* for the label 16 and a containment area 100*b* of the editorial product 11, respectively. A second transversal welding line 23, on the other hand, defines a head of the packing 100 and a tail of the subsequent packaging, thus creating the separation of the packaging 100.

FIG. 3, on the other hand, shows a detail of the packaging machine 10 for the application of the method according to the present invention for the production of packagings 100' shown in FIG. 4, wherein the preprinted self-adhesive labels 16 are applied transversally to the film 12, for example produced in two pieces.

The plastic film 12 is therefore folded over the editorial products 11 along the two opposite edges, creating a superimposing area 24, in a substantially central position, on which a longitudinal welding line 20' is effected.

Two transversal welding lines 22 and 23, according to what is specified above, form the packaging 100', which also comprises a containment area 100*a* for the label 16 and a containment area for the editorial product 11 and separate it from the film 12 being fed.

The method for the packaging of editorial products made of plastic film, object of the present invention, has the advantage of being able to be applied on traditional packaging machines with minimum adaptations.

A further advantage of the method, object of the present invention consists in the possibility of personalizing the labels on the part of the user.

The packaging of editorial products, object of the present invention, can be advantageously provided, already in the packaging phase with the plastic film, with a label on which the shipping address is printed. Printed labels are also advantageously housed inside the plastic film and are protected for example from water.

The packaging method of editorial products in plastic film and the relative packaging thus conceived can undergo numerous modifications and variants, all included in the invention; furthermore, all the details can be substituted with technically equivalent elements. In practice, the materials used, as also the dimensions, can vary according to technical requirements.

The invention claimed is:

1. A method for the packaging of editorial products (11) in plastic film comprising the phases of unwinding a plastic film (12) from a bobbin (13) and feeding the plastic film in a longitudinal direction (F), adhering preprinted self-adhesive labels (16) to said film (12) transversally with respect to said longitudinal direction (F) and distanced between each other by a pre-established length greater than the length of the editorial products (11) to be packaged, positioning said editorial products (11) on said film (12) in the space between two of the adhered labels (16), folding the plastic film (12) over said editorial products (11) and the labels, longitudinally welding the plastic film (12) folded over said editorial products (11) and the labels, welding the plastic film (12) transversally with a first transversal welding line (22) to form a first containment area (100*a*) for said label (16) and a second containment area (100*b*) for said editorial product (11) respectively, and also with a second transversal welding line (23) forming a head of a finished packaging (100, 100') and a tail of a subsequent packaging, said second transversal welding also effecting the separation of said finished packaging (100, 100').

2. The method according to claim 1, characterized in that said preprinted self-adhesive labels (16) are all the same as each other and fed by a roll feeder.

3. The method according to claim 1, characterized in that said preprinted self-adhesive labels (16) can be personalized and fed by a labeling machine equipped with a printing head.

4. A method for the packaging of editorial products (11) in plastic film comprising the phases of unwinding a plastic film (12) from a bobbin (13) and feeding the plastic film in a longitudinal direction (F), adhering preprinted self-adhesive labels (16) to said film (12) transversally with respect to said longitudinal direction (F) and distanced between each other by a pre-established length greater than the length of the editorial products (11) to be packaged, positioning said editorial products (11) on said film (12) in the space between two of the adhered labels (16), folding the plastic film (12) over said editorial products (11) and the labels, longitudinally welding the plastic film (12) folded over said editorial products (11) and the labels, welding the plastic film (12) transversally with a first transversal welding line (22) to form a first containment area (100*a*) for said label (16) and a second containment area (100*b*) for said editorial product (11) respectively, and also with a second transversal welding line (23) forming a head of a finished packaging (100, 100') and a tail of a subsequent packaging, said second transversal welding also effecting the separation of said finished packaging (100, 100'), wherein said plastic film (12) is folded over said editorial products (11) along one of the editorial products edges and said longitudinal welding is effected laterally with respect to said editorial products (11) to form a welding line (20) and the cutting off of a scrap (19) of the plastic film (12).

* * * * *